United States Patent [19]

Schallberg

[11] Patent Number: 4,631,846

[45] Date of Patent: Dec. 30, 1986

[54] TRANSPARENT SEPARATOR FOR A ROW OF INDEX CARDS OR THE LIKE

[76] Inventor: Heidi L. Schallberg, 6313 N. Bales, Kansas City, Mo. 64119

[21] Appl. No.: 670,908

[22] Filed: Nov. 13, 1984

[51] Int. Cl.[4] ..... B42F 17/02

[52] U.S. Cl. ..... 40/380

[58] Field of Search ..... 40/371, 372, 377, 379, 40/380; 116/324; 281/42; 312/183; 220/22.1; D19/90

[56] References Cited

U.S. PATENT DOCUMENTS

| | | | |
|---|---|---|---|
| 1,038,703 | 9/1912 | Wood | 206/425 |
| 1,228,789 | 5/1920 | Rand | 52/669 |
| 2,457,855 | 1/1949 | Weston | 40/383 |
| 2,689,571 | 9/1954 | Watkins | 40/360 |
| 3,086,658 | 4/1963 | Palmer | 211/50 |
| 3,250,274 | 5/1966 | Per Mathieson | 40/372 |
| 4,015,350 | 4/1977 | Zurwelle | 40/372 |

FOREIGN PATENT DOCUMENTS

| | | | |
|---|---|---|---|
| 548592 | 1/1952 | Canada | 40/372 |

*Primary Examiner*—Gene Mancene

*Assistant Examiner*—Cary E. Stone

[57] ABSTRACT

In the field of library science wherein literary, artistic and shelved collections of various materials are descriptively classified by rows of catalog cards maintained upright in open top, pullout drawers, a rigid, inexpensive, light weight, V-shaped, suspendible separator, provided with an upwardly open, finger-clearing mouth, has a handle integral with its rectangular, transparent, rearmost leg for ease of insertion in a chosen drawer between a pair of pre-selected cards, operating to maintain the two cards tilted in opposite directions such that the card engaged by the transparent leg therebehind is conveniently held at a proper, rearwardly tilted angle for full, unobstructed viewing through the transparent leg of the call number and other data on the front face of the rearwardly tilted card, thereby freeing the hands of the user for rapid, accurate copying of all or portions of such data as may be desired without risk of losing his place. A central notch across the apex or bight of the separator clears the card-retaining rod of the drawer such that the transversely arcuate bight of the inserted separator rests on the bottom of the drawer.

6 Claims, 4 Drawing Figures

TRANSPARENT SEPARATOR FOR A ROW OF INDEX CARDS OR THE LIKE

BACKGROUND OF THE INVENTION

Descriptive classification of collections such as reading and reference materials, accessible from shelving and other storage facilities involves the widespread use of corresponding synopses, including titles, authors and call numbers on groups of individual cards readily available for thumbing and careful selection of preferred items. Normally each series of cards is arranged in a row resting on one edge and contained in boxes or open-top drawers but, because of what might be called "the domino" effect, they tend to tilt, causing one to lose his place much the same as the way in which the pages of a book flip over when not carefully held or anchored.

Thus, the aggravating problem of attempting to awkwardly copy from a preselected card, while at the same time, keeping the card in full view. Exasperated, the searcher inserts a pencil, a piece of paper or other item, none of which ever seems to be readily available and, usually, without successfully spreading the cards sufficiently or preventing blockage from view of that which is to be copied.

SUMMARY OF THE INVENTION

In the present invention, a satisfactory solution to the long existing problems lies in the provision of an insert which has several essential advantages: (a) holding a pair of cards within the row separated and against tilt-over, (b) maintaining the selected card at a proper angle for viewing, (c) eliminating all obstruction to reading its entire descriptive material and (d) freeing the hands for rapid and accurate copying.

My invention is a rigid V-shaped separator handily suspendible at the work place where the cards of the library drawer are to be thumbed. When a card to be copied is selected, the separator, by use of a handle thereon, may be quickly and easily inserted into the drawer in front of the chosen card. One leg of the inserted item holds the card therebehind at a proper rearward incline. The other leg precludes the cards in front thereof from tilting rearwardly. The bight of the retention device rests on the bottom of the drawer.

The user then has one hand free to hold the call slip and the other hand free for writing. All the while, everything to be read is clearly visible because of the transparent nature of at least the rear leg. Librarians, businesses, institutions and the public generally will readily recognize the benefits to be gained from the use of such an inexpensive adjunct to the system and will demand its availability as a valuable, if not necessary, convenience.

IN THE DRAWING

DESCRIPTION OF THE PREFERRED EMBODIMENT

Figure 1:
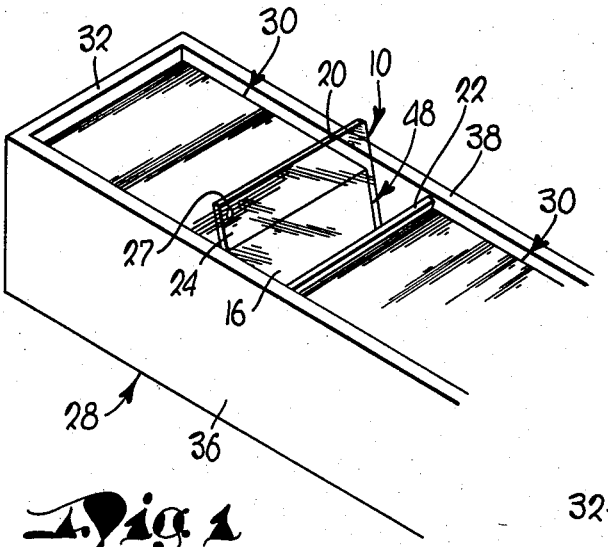
FIG. 1 is a fragmentary, perspective view of a library drawer containing a row of catalog cards, showing for use therewith a transparent separator made in accordance with my present invention.
Figure 2:
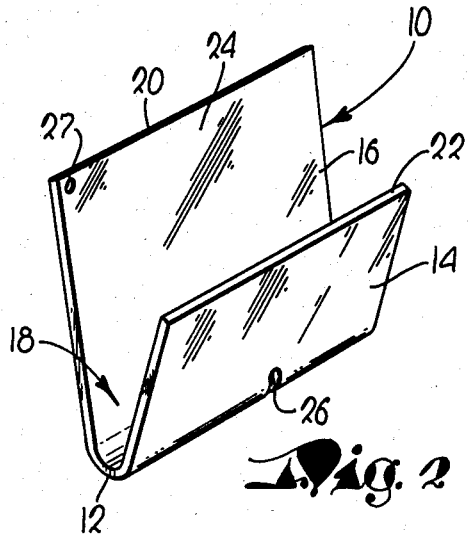
FIG. 2 is an enlarged, perspective view of the separator removed from the row of cards to be retained thereby.
Figure 4:
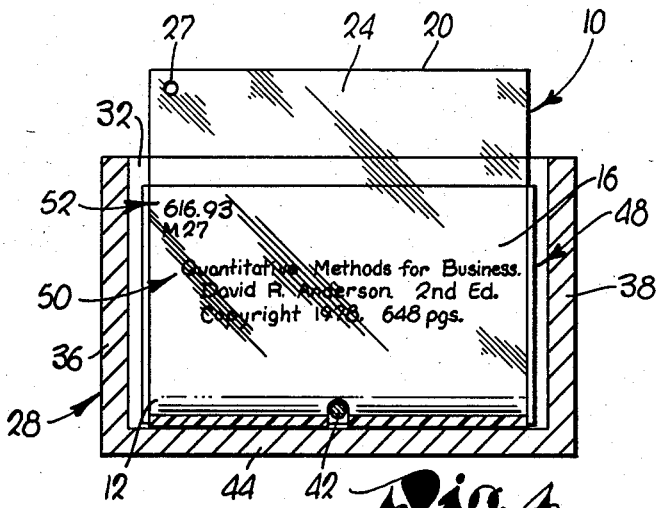
FIG. 4 is a transverse, cross-sectional view taken on line 4—4 of FIG. 3.
Figure 3:
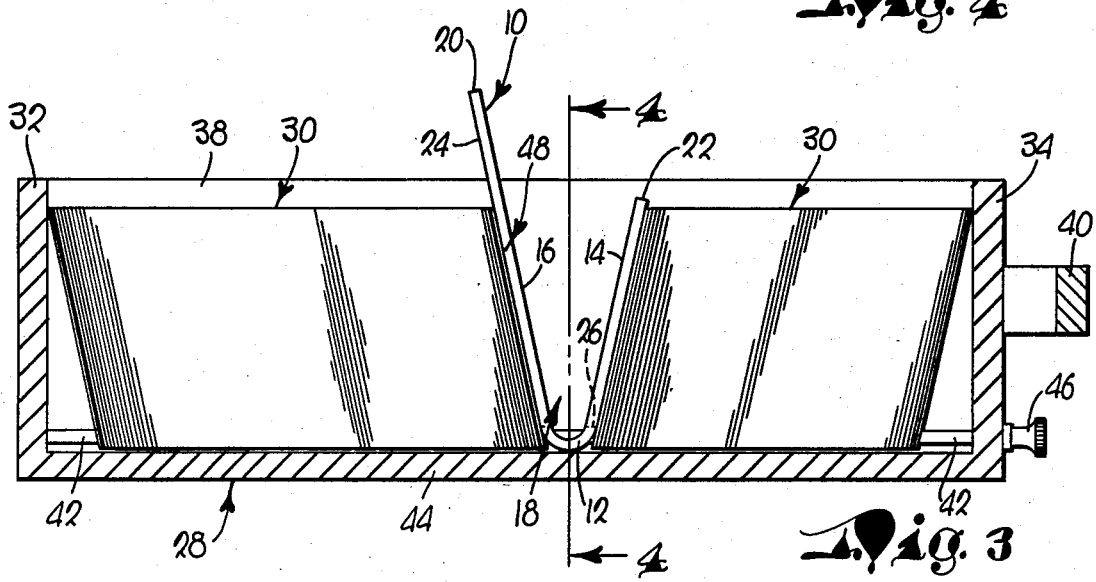
FIG. 3 is a longitudinal, essentially central, cross-sectional view, still further enlarged, through the container shown in FIG. 1.

A separator, having retention or holding and spreading capabilities broadly designated 10 in the drawing, is essentially V-shaped, presenting a lower, transversely arcuate apex or bight 12, a rectangular front leg 14 and a transparent, rectangular rear leg 16, both being integral with the bight 12 and converging as the bight 12 is approached, presenting an upwardly opening mouth 18 between the legs 14 and 16. The distance between the bight 12 and an upper, elongated edge 20 of the leg 16 is greater than the distance between the bight 12 and and an upper, elongated edge 22 of the leg 14, presenting a rectangular handle 24 coextensive in length with the legs 14 and 16. A clearance notch 26 traverses the bight 12 midway the ends of the separator 10, and a hole 27 is provided in the handle 24 adjacent one of its upper corners near the edge 20.

The separator 10 is made from a smooth, tough, relatively rigid, lightweight plate of transparent plastic sufficiently thick and of such an inherent composition as to be somewhat unbendible or inflexible so that the legs 14 and 16 cannot fold toward or away from each other and so that the separator 10 will not break at the bight 12 or elsewhere during normal use.

Exemplary in the drawing of one of the many important uses for the separator 10 is an elongated, relatively narrow and shallow, open top drawer 28 commonly used in libraries to contain a row 30 of tiltable catalog cards between end walls 32 and 34 of the drawer 28 and substantially spanning the distance between side walls 36 and 38 of the drawer 28, but rising, when the cards are upright, no higher than the upper edges of the walls 32, 34, 36 and 38. The wall 34 has a pull-out, hand-grasping attachment 40 and the drawer 28 has a medium card retention rod 42 extending through the wall 34 and into the wall 32 adjacent bottom 44 of the drawer 28. The rod 42 passes through an opening in each of the cards of the row 32 and a knurled knob 46 on the rod 42 below the attachment 40 is used to remove the rod 42.

OPERATION

When a book is to be selected from the shelves of the stacks of the library, the appropriately marked drawer 28 is removed from its cavity by use of the attachment 40 and placed on a shelf, table or stand. The cards in the row 30 are thumbed through until a card 48 corresponding to the desired book is located by virtue of the description 50 appearing on its forwardly facing surface.

The separator 10, handily located through use of a suspending chain connected thereto by use of the hole 27, is inserted between the card 48 and the card in front thereof such that the latter is held by the leg 14 at a slight forward tilt. The leg 36 holds the card 48 tilted rearwardly and, as the separator 10 is shifted downwardly, the bight 12 comes to rest on the bottom 44 with the legs 14 and 16 engaging proximal cards and with the rod 42 cleared by the notch 26.

At this point the hands of the user are free, no longer needed to hold the tilted cards apart because the separator 10 operates as a retainer and the user need not fear losing his place in the row 30. Thus, the description 50 can be read through the leg 16 and the call number 52 on the card 48 can be written down on a call slip, a supply of which is usually available at the zone of book selection.

Insertion and removal of the separator 10 is facilitated by the handle 24 because of the finger-clearing mouth 18 and the fact that the handle 24 rises above the cards in the row 30 and above the drawer 28. The leg 14 does rise appreciably above the cards and, therefore, does not interfere with the viewing of the card 48 through the leg 16.

By providing a multitude of the separators 20 in all libraries, one at each of the many points where there is reason or desire to use the drawers 28 to select, view and make notes of data appearing on one or more cards, a long felt need will be met and the problems above-described, not heretofore solved, will disappear, with little attended expense, but with great pleasure and gratification by patrons and library personnel alike.

The use of my invention is not limited to public libraries but has the same advantages whereever there is a collection of books, periodicals, magazines, newspapers, documents, pamphlets and other publications. Such collections also exist in research, technical, historical and school libraries as well as in special libraries such as in hospitals, prisons, and firms as well as those maintained by newspapers, research bodies, learned societies, professional associations and governmental agencies.

Moreover, use of my separator 10 is not limited to cards or to storage drawers as shown at 28 in the drawings, and, under some conditions either or both of the legs 14, 16 and/or the bight 12 might well be appreciably shorter than the lengths of the cards or other data-recording members. Moreover, the shape and size of the handle 24 may be varied as needed or desired. Nor, in all instances will there be a need for the notch 26 or the hole 27, or for use of plastic as the material from which the separator 10 is made. It is therefore desired to be limited only the the scope of the appended claims as fairly interpreted in view of the drawing and the above description.

Having thus described the invention, what is claimed as new and desired to be secured by Letters Patent is:

1. In the field of library science wherein literary, artistic and other shelved collections of various materials are descriptively classified by rows of catalog cards maintained upright in open top, pull-out drawers each having a card-retaining rod, a V-shaped separator provided with:

an elongated, transversely arcuate bight having a transverse, rod-clearing notch, a rectangular, rearmost, plate-like leg and a rectangular, forwardmost, plate-like leg, said legs being integral with and converging downwardly and inwardly as said bight is approached, each leg having an elongated uppermost edge, the distance between the bight and said edge of the rearmost leg being greater than the distance between the bight and said edge of the forwardmost leg, presenting a rectangular handle integral with the rearmost leg for use in manual insertion of the separator into a chosen drawer between and in engagement with a pair of preselected cards, said handle having a hole for use in suspending the separator from a suitable support at a point of use, there being an upwardly opening mouth between the legs for clearing the fingers of the user during insertion of the separator into the chosen drawer, said handle extending above the card which is proximal to and behind the rearmost leg, when the separator is inserted into the chosen drawer between said card and the next adjacent card, said separator being rigid and said rearmost leg sloping upwardly and rearwardly from the bight when the separator is inserted between said cards for holding said proximal card tilted rearwardly, said rearmost leg being transparent, permitting descriptive data on the front face of said tilted card to be viewed through the rearmost leg.

2. In the field of library science wherein literary, artistic and other shelved collections of various materials are descriptively classified by rows of catalog cards maintained upright in open top, pull-out drawers each having a card-retaining rod, a V-shaped retainer provided with:

an elongated, transversely arcuate bight having a transverse, rod-clearing notch, a rectangular, rearmost, plate-like leg and a rectangular, forwardmost plate-like leg, said legs being integral with and converging downwardly and inwardly as said bight is approached, each leg having an elongated uppermost edge, the distance between the bight and said edge of one of said legs being greater than the distance between the bight and said edge of the other of said legs, said one leg thereby presenting a rectangular handle integral with said one leg for use in manual insertion of the retainer into a chosen drawer between and in engagement with a pair of preselected cards, said handle extending above said cards when said retainer is inserted into the chosen drawer, said retainer being rigid and said rearmost leg sloping upwardly and rearwardly from the bight when the separator is inserted between said cards for holding the card proximal to the rearmost leg in a rearwardly tilted position, said rearmost leg presenting a window for viewing descriptive data on the front face of said rearwardly tilted card.

3. The invention of claim 2, said one leg being said rearmost leg.

4. The invention of claim 2, one of said legs having a hole therethrough for use in suspending the retainer from a suitable support at a point of use.

5. The invention of claim 2, said rearmost leg being formed of clear synthetic resin material.

6. A separator device for separating adjacent cards maintained in an upright position in an open top, pullout drawer having an elongated card-retaining rod, said device comprising:

a generally V-shaped body presenting a front leg and a rear leg, said legs extending upwardly and diverging from one another and being interconnected adjacent the lower ends thereof, each of said legs being of a height to extend from a point adjacent the top of said cards to a point adjacent the bottom thereof, and each of said legs further being of a width less than the width of said drawer to permit insertion of said device into said drawer between a pair of adjacent cards with the legs in engagement with substantially the entire proximal faces of said cards, there being structure defining a notch in the region of said body where said legs are interconnected for receiving said rod, said rear leg presenting a window for viewing of descriptive data on the face of the card in engagement with said rear leg.

* * * * *